US009879511B2

(12) United States Patent
Mazyar et al.

(10) Patent No.: US 9,879,511 B2
(45) Date of Patent: Jan. 30, 2018

(54) METHODS OF OBTAINING A HYDROCARBON MATERIAL CONTAINED WITHIN A SUBTERRANEAN FORMATION

(71) Applicant: Baker Hughes Incorporated, Houston, TX (US)

(72) Inventors: Oleg A. Mazyar, Houston, TX (US); Oleksandr V. Kuznetsov, Houston, TX (US); Gaurav Agrawal, Aurora, CO (US); Michael H. Johnson, Spring, TX (US); Valery N. Khabashesku, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 87 days.

(21) Appl. No.: 14/088,331

(22) Filed: Nov. 22, 2013

(65) Prior Publication Data

US 2015/0144343 A1 May 28, 2015

(51) Int. Cl.
*C09K 8/68* (2006.01)
*E21B 43/16* (2006.01)

(52) U.S. Cl.
CPC ..... *E21B 43/16* (2013.01)

(58) Field of Classification Search
CPC ..... E21B 43/22; C09K 8/892
See application file for complete search history.

(56) References Cited

U.S. PATENT DOCUMENTS 4,330,037 A 5/1982 Richardson et al.
4,466,885 A * 8/1984 Ronden ..... 208/188
4,615,391 A 10/1986 Garthoffner
5,674,620 A 10/1997 Puiia et al.
5,855,243 A * 1/1999 Bragg ..... C09K 8/26 166/275
6,287,360 B1 9/2001 Kembaiyan et al.
8,191,658 B2 6/2012 Schmitz et al.
8,278,251 B2 10/2012 Huang
(Continued)

FOREIGN PATENT DOCUMENTS

CA 1214989 12/1986
CN 1927895 A 3/2007
(Continued)

OTHER PUBLICATIONS

Kelland. Production Chemicals for the Oil and Gas Industry (Chapter 11).*
(Continued)

*Primary Examiner* — Doug Hutton, Jr.
*Assistant Examiner* — Avi Skaist
(74) *Attorney, Agent, or Firm* — TraskBritt

(57) ABSTRACT

A method of obtaining a hydrocarbon material from a subterranean formation comprises forming a flooding suspension comprising degradable particles and a carrier fluid. The flooding suspension is introduced into a subterranean formation containing a hydrocarbon material to form an emulsion stabilized by the degradable particles and remove the emulsion from the subterranean formation. At least a portion of the degradable particles are degraded to destabilize the emulsion. An additional method of obtaining a hydrocarbon material from a subterranean formation, and a stabilized emulsion are also described.

10 Claims, 1 Drawing Sheet

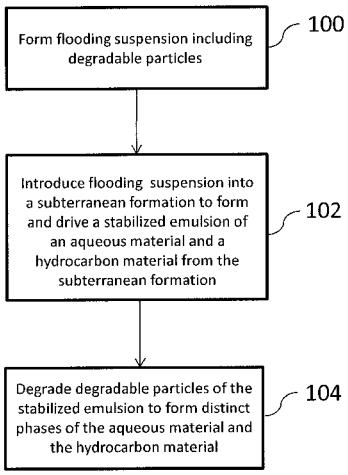

(56) References Cited

U.S. PATENT DOCUMENTS

| | | | | |
|---|---|---|---|---|
| 8,528,633 | B2 | 9/2013 | Agrawal et al. | |
| 2006/0167147 | A1* | 7/2006 | Asgari | A61K 9/0024 524/174 |
| 2006/0169450 | A1 | 8/2006 | Mang et al. | |
| 2007/0181224 | A1 | 8/2007 | Marya et al. | |
| 2007/0202318 | A1 | 8/2007 | Smith et al. | |
| 2008/0069961 | A1 | 3/2008 | Sarkar et al. | |
| 2009/0137432 | A1* | 5/2009 | Sullivan et al. | 507/219 |
| 2009/0211758 | A1* | 8/2009 | Bragg et al. | 166/275 |
| 2010/0083583 | A1 | 4/2010 | Sumiya et al. | |
| 2010/0243248 | A1* | 9/2010 | Golomb et al. | 166/270 |
| 2010/0300764 | A1 | 12/2010 | Naidoo et al. | |
| 2010/0326662 | A1 | 12/2010 | Kaminsky et al. | |
| 2011/0114323 | A1 | 5/2011 | Jennings et al. | |
| 2011/0132621 | A1 | 6/2011 | Agrawal et al. | |
| 2011/0278002 | A1 | 11/2011 | McGuire et al. | |
| 2013/0043028 | A1 | 2/2013 | Chakraborty et al. | |
| 2013/0140240 | A1 | 6/2013 | Mazyar | |
| 2013/0206400 | A1 | 8/2013 | Alexandrov et al. | |
| 2013/0206425 | A1 | 8/2013 | Mazyar et al. | |
| 2013/0220616 | A1 | 8/2013 | Seth et al. | |
| 2013/0300066 | A1 | 11/2013 | Xu et al. | |
| 2014/0224483 | A1 | 8/2014 | Hart | |
| 2015/0144344 | A1 | 5/2015 | Mazyar et al. | |

FOREIGN PATENT DOCUMENTS

| | | | |
|---|---|---|---|
| CN | 102504795 | A | 6/2012 |
| CN | 103080471 | A | 5/2013 |
| EP | 1116858 | | 7/2001 |

OTHER PUBLICATIONS

Pardo et al., Corrosion Behaviour of Magnesium/Aluminium Alloys in 3.5 wt.% NaCl, Corrosion Science, vol. 50, (2008). pp. 823-834.

Song et al., Understanding Magnesium Corrosion, Advanced Engineering Materials, vol. 5, No. 12, (2003), pp. 837-858.

International Preliminary Report on Patentability for International Application No. PCT/US2014/016559, dated May 24, 2016, 9 pages.

International Search Report for International Application No. PCT/US2014/016559, dated Jan. 27, 2015, 3 pages.

International Written Opinion for International Application No. PCT/US2014/016559, dated Jan. 27, 2015, 8 pages.

Chinese First Office Action for Chinese Application No. 2014800702572, dated Jun. 7, 2017, 19 pages.

Chinese First Search for Chinese Application No. 2014800702572, dated May 22, 2017, 2 pages.

* cited by examiner

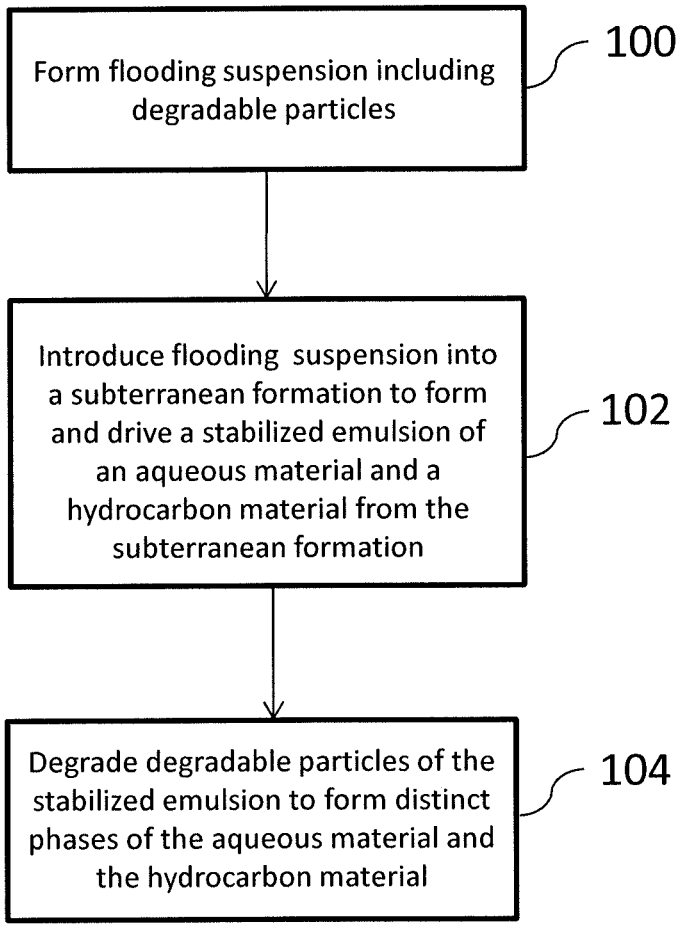
Form flooding suspension including degradable particles
100
Introduce flooding suspension into a subterranean formation to form and drive a stabilized emulsion of an aqueous material and a hydrocarbon material from the subterranean formation
102
Degrade degradable particles of the stabilized emulsion to form distinct phases of the aqueous material and the hydrocarbon material
104

METHODS OF OBTAINING A HYDROCARBON MATERIAL CONTAINED WITHIN A SUBTERRANEAN FORMATION

TECHNICAL FIELD

Embodiments of the disclosure relate generally to methods of obtaining a hydrocarbon material contained within a subterranean formation, and to stabilized emulsions. More particularly, embodiments of the disclosure relate to methods of obtaining a hydrocarbon material from a subterranean formation using a flooding suspension including degradable particles, and to stabilized emulsions including degradable particles.

BACKGROUND

Water flooding is a conventional process of enhancing the extraction of hydrocarbon materials (e.g., crude oil, natural gas, etc.) from subterranean formations. In this process, an aqueous fluid (e.g., water, brine, etc.) is injected into the subterranean formation through injection wells to sweep a hydrocarbon material contained within interstitial spaces (e.g., pores, cracks, fractures, channels, etc.) of the subterranean formation toward production wells. One or more additives may be added to the aqueous fluid to assist in the extraction and subsequent processing of the hydrocarbon material.

For example, in some approaches, a surfactant and/or solid particles are added to the aqueous fluid. The surfactant and/or the solid particles can adhere to or gather at interfaces between a hydrocarbon material and an aqueous material to form a stabilized emulsion of one of the hydrocarbon material and the aqueous material dispersed in the other of the hydrocarbon material and the aqueous material. Stabilization by the surfactant and/or the solid particles lowers the energy of the system, preventing the dispersed material (e.g., the hydrocarbon material, or the aqueous material) from coalescing, and maintaining the one material dispersed as units (e.g., droplets) throughout the other material. In turn, the hydrocarbon material may be more easily transported through and extracted from the subterranean formation as compared to water flooding processes that do not employ the addition of a surfactant and/or solid particles.

Disadvantageously, however, the affectivity of various surfactants can be detrimentally reduced by the presence of dissolved salts (e.g., such as various salts typically present within a subterranean formation). In addition, surfactants can have a tendency to adhere to surfaces of the subterranean formation, requiring the economically undesirable addition of more surfactant to the injected aqueous fluid to account for such losses. Furthermore, solid particles can be difficult to remove from the stabilized emulsion during subsequent processing, preventing the hydrocarbon material and the aqueous material thereof from coalescing into distinct, immiscible components, and greatly inhibiting the separate collection of the hydrocarbon material.

It would, therefore, be desirable to have an improved method of extracting a hydrocarbon material from a subterranean formation to overcome one or more of the above problems.

BRIEF SUMMARY

Embodiments described herein include methods of obtaining a hydrocarbon material from a subterranean formation, as well as related stabilized emulsions. For example, in accordance with one embodiment described herein, a method of obtaining a hydrocarbon material from a subterranean formation comprises forming a flooding suspension comprising degradable particles and a carrier fluid. The flooding suspension is introduced into a subterranean formation containing a hydrocarbon material to form an emulsion stabilized by the degradable particles and remove the emulsion from the subterranean formation. At least a portion of the degradable particles are degraded to destabilize the emulsion.

In additional embodiments, a method of obtaining a hydrocarbon material from a subterranean formation comprises forming nanoparticles comprising at least one of Mg, Al, Ca, Mn, and Zn. The nanoparticles are combined with a carrier fluid to form a flooding suspension. The flooding suspension is injected into a subterranean formation having a hydrocarbon material attached to surfaces thereof to detach the hydrocarbon material from the surfaces and form an emulsion stabilized by the nanoparticles. The emulsion is directed out of the subterranean formation. At least one of a temperature, pH, and material composition, and pressure of the stabilized emulsion is modified to react at least a portion of the nanoparticles with the aqueous material to destabilize the emulsion and coalesce the hydrocarbon material.

In further embodiments, a stabilized emulsion comprises a dispersed phase comprising a hydrocarbon material, a continuous phase comprising an aqueous material, and hydrophilic nanoparticles gathered at interfaces of the dispersed phase and the continuous phase. At least some of the hydrophilic nanoparticles comprise an Mg—Al alloy formulated to switch from a first corrosion rate to a second, faster corrosion rate in response to at least one of an increase in the temperature of the aqueous material and a decrease in the pH of the aqueous material.

BRIEF DESCRIPTION OF THE DRAWING

FIG. 1 is a simplified flow diagram depicting a method of exacting extracting hydrocarbons from a subterranean formation, in accordance with embodiments of the disclosure.

DETAILED DESCRIPTION

Methods of extracting a hydrocarbon material from a subterranean formation are described. In some embodiments, a method of extracting hydrocarbons from a subterranean formation includes forming a flooding suspension comprising degradable particles and a carrier fluid. The degradable particles may be structured and formulated to controllably degrade (e.g., corrode, dissolve, decompose, etc.) during interaction with one or more materials delivered to and/or already present within the subterranean formation. The flooding suspension may be delivered into the subterranean formation to detach a hydrocarbon material from surfaces of the subterranean formation. The degradable particles may gather at, adhere to, and/or adsorb to interfaces of the hydrocarbon material and an aqueous material to form a stabilized emulsion (e.g., a Pickering emulsion) comprising units of one of the hydrocarbon material and the aqueous material dispersed in the other of the hydrocarbon material and an aqueous material. The stabilized emulsion may be flowed (e.g., driven, swept, forced, etc.) from the subterranean formation. Following removal from the subterranean formation, the degradable particles are degraded (e.g., corroded, dissolved, decomposed, etc.). The degradable particles may degrade under the properties (e.g., temperature, pH, material composition, etc.) of the stabilized emulsion over time, or at least one property of the stabilized emulsion may be modified to facilitate or enhance degradation of the degradable particles. The degradation of the degradable particles may destabilize the emulsion, and enable the hydrocarbon material and the aqueous material to coalesce into distinct, immiscible phases. The hydrocarbon material may then be collected separate from the aqueous material and utilized as desired. The methods of the disclosure may increase the simplicity and efficiency, and reduce the costs of obtaining (e.g., extracting and separating) a hydrocarbon material from a subterranean formation as compared to conventional extraction methods.

The following description provides specific details, such as material types, compositions, material thicknesses, and processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional techniques employed in the industry. In addition, the description provided below does not form a complete process flow for recovering hydrocarbons from a hydrocarbon-bearing subterranean formation. Only those process acts and structures necessary to understand the embodiments of the disclosure are described in detail below. A person of ordinary skill in the art will understand that some process components (e.g., pipelines, line filters, valves, temperature detectors, flow detectors, pressure detectors, and the like) are inherently disclosed herein and that adding various conventional process components and acts would be in accord with the disclosure.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the singular forms "a," "an," and "the" are intended to include the plural forms as well, unless the context clearly indicates otherwise.

As used herein, the term "and/or" includes any and all combinations of one or more of the associated listed items.

As used herein, relational terms, such as "first," "second," "top," "bottom," "upper," "lower," "over," "under," etc., are used for clarity and convenience in understanding the disclosure and accompanying drawings and does not connote or depend on any specific preference, orientation, or order, except where the context clearly indicates otherwise.

As used herein, the term "substantially," in reference to a given parameter, property, or condition, means to a degree that one of ordinary skill in the art would understand that the given parameter, property, or condition is met with a small degree of variance, such as within acceptable manufacturing tolerances.

As used herein, the term "about" in reference to a given parameter is inclusive of the stated value and has the meaning dictated by the context (e.g., it includes the degree of error associated with measurement of the given parameter).

FIG. 1 is a simplified flow diagram illustrating a method of obtaining a hydrocarbon material contained within a subterranean formation, in accordance with embodiments of the disclosure. The method may include a suspension formation process 100 including forming a flooding suspension including a plurality of degradable particles; a flooding process 102 including introducing the flooding suspension into a subterranean formation to detach a hydrocarbon material from surfaces of the subterranean formation, form a stabilized emulsion of the hydrocarbon material and an aqueous material, and flow (e.g., drive, sweep, force, etc.) the stabilized emulsion from the subterranean formation; and a degradation process 104 including degrading at least a portion of the degradable particles of the stabilized emulsion to destabilize the emulsion and coalesce the hydrocarbon material and the aqueous material into distinct, immiscible phases. With the description as provided below, it will be readily apparent to one of ordinary skill in the art that the method described herein may be used in various applications. In other words, the method may be used whenever it is desired to extract and separate a hydrocarbon material.

Referring to FIG. 1, the suspension formation process 100 includes forming a flooding suspension including degradable particles and at least one carrier fluid. The degradable particles may be formed of and include at least one material that is degradable (e.g., corrodible, dissolvable, decomposable, etc.) in the presence of at least one of an aqueous material and an organic material, such as those that may be found in the downhole environment of a subterranean formation. For example, the degradable particles may be corrodible, dissolvable, and/or decomposable in the presence of the various aqueous materials (e.g., water, brines, etc.) that may be delivered to and/or already present within a subterranean formation. The degradable particles of the flooding suspension may be compatible with the other components (e.g., materials, constituents, etc.) of the flooding suspension. As used herein, the term "compatible" means that a material does not react, decompose, or absorb another material in an unintended way, and also that the material does not impair the chemical and/or mechanical properties of the another material in an unintended way. For example, each of the degradable particles may be structured (e.g., sized, shaped, layered, etc.) and formulated such that the degradable particles do not substantially react with another material (e.g., an aqueous material, a hydrocarbon material, etc.) under the conditions (e.g., temperature, pressure, pH, flow rate, material exposure, etc.) in which the degradable particles are provided into and removed from a subterranean formation.

The degradable particles are structured and formulated to exhibit selectable and controllable degradation (e.g., corrosion, dissolution, decomposition, etc.) properties. The degradable particles may be formed of and include a material that degrades in response to a change in at least one environmental condition (e.g., temperature, pH, material exposure, etc.) to which the degradable particles are exposed, and/or may be formed of and include a material that degrades in a desired manner (e.g., at a desired degradation rate) without a change in the environmental conditions to which the degradable particles are exposed. By way of non-limiting example, at least a portion of each of the degradable particles may be formed of and include at least one material that switches from a first degradation rate to a second, faster degradation rate in response to a change in at least one environmental condition (e.g., temperature, pH, material exposure, etc.). For example, at least a portion of the degradable particles may exhibit a relatively slow degradation rate, including a zero degradation rate, when exposed to a first material (e.g., an organic material), but may exhibit a faster degradation rate upon exposure to a second material (e.g., an aqueous material). As another example, at least a portion of the degradable particles may exhibit a relatively slow degradation rate in an aqueous material at a first temperature and/or a first pH, but may exhibit a faster degradation rate in the aqueous material at second, higher temperature and/or a second, lower pH. The selectable and controllable degradation properties of the degradable particles may enable the chemical and/or mechanical properties of degradable particles to be maintained until the degradable particles fulfill at least one desired function, at which time at least one ambient environmental condition may be changed to promote the at least partial removal (e.g., by way of corrosion and/or dissolution) of the degradable particles.

In addition, the degradable particles are structured and formulated to remove a hydrocarbon material from at least one surface of a subterranean formation. For example, at least a portion of the degradable particles may be structured and formulated to be at least partially abrasive. As used herein, the term "abrasive" means that a structure (e.g., particle) is able to mar, scratch, scrape, gouge, abrade, and/or shear a material from a surface. The degradable particles may be structured and formulated to abrasively remove the hydrocarbon material from the surface of the subterranean formation upon contacting an interface of the hydrocarbon material and the subterranean formation.

Furthermore, the degradable particles are structured and formulated to facilitate the formation of a stabilized emulsion of a hydrocarbon material and an aqueous material. For example, the degradable particles may be structured and formulated to gather (e.g., agglomerate) at, adhere to, and/or adsorb to interfaces of a hydrocarbon material and an aqueous material to form a Pickering emulsion comprising units (e.g., droplets) of one of the hydrocarbon material and the aqueous material dispersed in the other of the hydrocarbon material and an aqueous material. The degradable particles may prevent the dispersed material (e.g., the hydrocarbon material, or the aqueous material) from coalescing, and may thus maintain the dispersed material as units throughout the other material. In turn, degrading (e.g., corroding, dissolving, decomposing, etc.) the degradable particles may destabilize the emulsion so that the hydrocarbon material and the aqueous material coalesce into distinct, immiscible phases.

As a non-limiting example, at least a portion of the degradable particles may be formed of and include a metal material that is controllably degradable (e.g., corrodible, dissolvable, decomposable, etc.) in the presence of an aqueous material, such as an aqueous material typically found in a downhole environment (e.g., an aqueous material comprising water and at least one of an alcohol, ammonium chloride, calcium chloride, calcium bromide, hydrochloric acid, hydrogen sulfide, magnesium chloride, magnesium boride, potassium chloride, potassium formate, sodium chloride, sodium boride, sodium formate, zinc bromide, zinc bromide, zinc formate, and zinc oxide, a different salt, and different corrosive material). The metal material may be formed of and include an active metal having a standard oxidation potential greater than or equal to that of zinc (Zn). The active metal may be relatively anodic in the presence of the aqueous material. For example, the active metal may comprise magnesium (Mg), aluminum (Al), calcium (Ca), manganese (Mn), or Zn. In some embodiments, active metal is Mg. In addition, the metal material may, optionally, be formed of include at least one additional constituent. The additional constituent may influence one or more properties of the active metal. For example, the additional constituent may adjust (e.g., increase, or decrease) the degradation (e.g., corrosion and/or dissolution) rate of the active metal in the aqueous material. The additional constituent may be relatively cathodic in the presence of the aqueous material. By way of non-limiting example, depending on the active metal, the additional constituent may comprise at least one of aluminum (Al), bismuth (Bi), cadmium (Cd), calcium (Ca), cerium (Ce), cobalt (Co), copper (Cu), iron (Fe), gallium (Ga), indium (In), lithium (Li), manganese (Mn), nickel (Ni), scandium (Sc), silicon (Si), silver (Ag), strontium (Sr), thorium (Th), tin (Sn), titanium (Ti), tungsten (W), yttrium (Y), zinc (Zn), and zirconium (Zr). In some embodiments, the additional constituent comprises at least one of Al, Ni, W, Co, Cu, and Fe. The active metal may be doped, alloyed, or otherwise combined (e.g., covered) with the additional constituent. Non-limiting examples of metal materials that may be included in the degradable particles, along with methods of forming the metal materials, are disclosed in U.S. patent application Ser. Nos. 13/466,311 and 12/633,677, the disclosure of each of which is hereby incorporated herein by reference in its entirety.

In some embodiments, at least a portion of the degradable particles are formed of and include an Mg alloy. Suitable Mg alloys include, but are not limited to, alloys of Mg and at least one of Al, Bi, Cd, Ca, Ce, Co, Cu, Fe, Ga, In, Li, Mn, Ni, Sc, Si, Ag, Sr, Th, Sn, Ti, W, Y, Zn, and Zr. For example, at least a portion of the degradable particles may be formed of and include an Mg—Zn alloy, an Mg—Al alloy, an Mg—Mn alloy, an Mg—Li alloy, an Mg—Ca alloy, an Mg—X alloy, and/or an Mg—Al—X alloy, where X includes at least one of Bi, Cd, Ca, Ce, Co, Cu, Fe, Ga, In, Li, Mn, Ni, Sc, Si, Ag, Sr, Th, Sn, Ti, W, Y, Zn, and Zr. The Mg alloy may, for example, include up to about 99% Mg, such as up to about 95% Mg, up to about 90% Mg, up to about 85% Mg, up to about 80% Mg, up to about 75% Mg, up to about 70% Mg, or up to about 65% Mg. As a non-limiting example, suitable Mg—Al—X alloys may include up to about 85% Mg, up to about 15% Al, and up to about 5% X. In addition, the Mg alloy may, optionally, be doped and/or otherwise combined with at least one of Al, Bi, Cd, Ca, Co, Cu, Fe, Ga, In, Li, Mn, Ni, Si, Ag, Sr, Th, Sn, Ti, W, Zn, and Zr. In additional embodiments, at least a portion of the degradable particles may be formed of and include pure Mg, or Mg doped and/or otherwise combined with at least one of Al, Bi, Cd, Ca, Ce, Co, Cu, Fe, Ga, In, Li, Mn, Ni, Sc, Si, Ag, Sr, Th, Sn, Ti, W, Y, Zn, and Zr.

In additional embodiments, at least a portion of the degradable particles are formed of and include an Al alloy. Suitable Al alloys include, but are not limited to, alloys of Al and at least one of Bi, Cd, Ca, Ce, Co, Cu, Fe, Ga, In, Li, Mn, Mg, Ni, Sc, Si, Ag, Sr, Th, Sn, Ti, W, Y, Zn, and Zr. For example, at least a portion of the degradable particles may be formed of and include an Al—Mg alloy, Al—Ca alloy, an Al—Ga alloy (e.g., 80Al-20Ga), an Al—In alloy, an Al—Ga—Bi alloy (e.g., 80Al-10Ga-10Bi), an Al—Ga—In alloy (e.g., 80Al-10Ga-10In), an Al—Ga—Bi—Sn alloy (e.g., Al—Ga—Bi—Sn), an Al—Ga—Zn alloy (e.g., 80Al-10Ga-10Zn), an Al—Ga—Mg alloy (e.g., 80Al-10Ga-10Mg), an Al—Ga—Zn—Mg alloy (e.g., 80Al-10Ga-5Zn-5Mg), an Al—Ga—Zn—Cu alloy (e.g., 85Al-5Ga-5Zn-5Cu), an Al—Ga—Bi—Sn alloy (e.g., 85Al—5Ga—5Bi—5Sn), an Al—

Zn—Bi—Sn alloy (e.g., 85Al-5Zn-5Bi-5Sn), an Al—Ga—Zn—Si alloy (e.g., 80Al-5Ga-5Zn-10Si), an Al—Ga—Zn—Bi—Sn alloy (e.g., 80Al-5Ga-5Zn-5Bi-5Sn, 90Al-2.5Ga-2.5Zn-2.5Bi-2.5Sn), an Al—Ga—Zn—Sn—Mg alloy (e.g., 75Al-5Ga-5Zn-5Sn-5Mg), an Al—Ga—Zn—Bi—Sn—Mg alloy (e.g., 65Al-10Ga-10Zn-5Sn-5Bi-5Mg), an Al—X alloy, and/or an Al—Ga—X alloy, where X includes at least one of Bi, Cd, Ca, Co, Cu, Fe, Ga, In, Li, Mn, Ni, Si, Ag, Sr, Th, Sn, Ti, W, Zn, and Zr. The Al alloy may, for example, include up to about 99% Al, such as up to about 95% Al, up to about 90% Al, up to about 85% Al, up to about 80% Al, up to about 75% Al, up to about 70% Al, or up to about 65% Al. In addition, the Al alloy may, optionally, be doped and/or otherwise combined with at least one of Bi, Cd, Ca, Ce, Co, Cu, Fe, Ga, In, Li, Mg, Mn, Ni, Sc, Si, Ag, Sr, Th, Sn, Ti, W, Y, Zn, and Zr. In additional embodiments, at least a portion of the degradable particles may be formed of and include pure Al, or Al doped and/or otherwise combined with at least one of Bi, Cd, Ca, Ce, Co, Cu, Fe, Ga, In, Li, Mg, Mn, Ni, Sc, Si, Ag, Sr, Th, Sn, Ti, W, Y, Zn, and Zr.

In further embodiments, at least a portion of the degradable particles are formed of and include a Ca alloy. Suitable Ca alloys include, but are not limited to, alloys of Ca and at least one of Al, Bi, Cd, Ce, Co, Cu, Fe, Ga, In, Li, Mn, Mg, Ni, Sc, Si, Ag, Sr, Th, Sn, Ti, W, Y, Zn, and Zr. For example, at least a portion of the degradable particles may be formed of and include a Ca—Li alloy, a Ca—Mg alloy, a Ca—Al alloy, a Ca—Zn alloy, a Ca—Li—Zn alloy, and/or a Ca—X alloy, where X includes at least one of Al, Bi, Cd, Co, Cu, Fe, Ga, In, Li, Mg, Mn, Ni, Si, Ag, Sr, Th, Sn, Ti, W, Zn, and Zr. The Ca alloy may, for example, include up to about 99% Ca, such as up to about 95% Ca, up to about 90% Ca, up to about 85% Ca, up to about 80% Ca, up to about 75% Ca, up to about 70% Ca, or up to about 65% Ca. In addition, the Ca alloy may, optionally, be doped and/or otherwise combined with at least one of Al, Bi, Cd, Ce, Co, Cu, Fe, Ga, In, Li, Mg, Mn, Ni, Sc, Si, Ag, Sr, Th, Sn, Ti, W, Zn, Y, and Zr. In additional embodiments, at least a portion of the degradable particles may be formed of and include pure Ca, or Ca doped and/or otherwise combined with at least one of Al, Bi, Cd, Ce, Co, Cu, Fe, Ga, In, Li, Mg, Mn, Ni, Sc, Si, Ag, Sr, Th, Sn, Ti, W, Zn, Y, and Zr.

As another non-limiting example, at least a portion of the degradable particles may be formed of and include a hydrolyzable polymer. As used herein, the term "hydrolyzable polymer" means and includes a polymer that can be at least partially depolymerized to lower molecular weight units by hydrolysis. The hydrolyzable polymer may be reactive with an aqueous material, such as at least one of a brine, and an aqueous acid material (e.g., hydrochloric acid, hydrobromic acid, nitric acid, sulfuric acid, phosphoric acid, formic acid, acetic acid, combinations thereof, etc.). For example, the hydrolyzable polymer may comprise at least one of a polylactide, poly(r-caprolactone), poly(dioxanone), a polyester, a polyglycolide, a polyketal (e.g., poly(cyclohexane-1,4-diyl acetone dimethylene ketal), poly(lactide-co-glycolide), a polyurea, a polyurethane, and a silylated polyurethane. In some embodiments, at least a portion of the degradable particles are formed of and include a polyurethane.

At least some of the degradable particles may comprise composite particles. As used herein, the term "composite particle" means and includes a particle including at least two constituent materials that remain distinct on a micrometric level while forming a single particle. For example, the composite particle may include a core of a first material at least partially encapsulated (e.g., covered, surrounded, etc.) by a shell of a second material. The core may, for example, be formed of and include a material that is relatively more degradable (e.g., corrodible, dissolvable, decomposable, etc.) in an aqueous material, and the shell may be formed of and include a material that is relatively (e.g., as compared to the core) less degradable in the aqueous material. By way of non-limiting example, the core may be formed of and include a metal material (e.g., at least one of Mg, Al, Ca, Mn, Zn, an alloy thereof, a combination thereof, etc.) or a hydrolyzable polymer (e.g., polylactide, poly(ϵ-caprolactone), poly(dioxanone), a polyester, a polyglycolide, a polyketal, poly(lactide-co-glycolide), a polyurea, a polyurethane, a silylated polyurethane, etc.), and the shell may be formed of and include a material relatively less degradable in an aqueous material, such as at least one of a less degradable polymer material, a less degradable crystalline material, a less degradable organic material, a less degradable inorganic material, a less degradable metallic material, a less degradable magnetic material, and a less degradable ceramic material.

In some embodiments, at least some of the degradable particles are formed of and include a core comprising an Mg alloy (e.g., an Mg—Al alloy) and a shell comprising an organic material. The organic material may at least partially surround the core, and may be formed of and include at least one organic compound. As a non-limiting example, the organic material may be a polymeric material formed of and including at least one polymer. The organic material may be attached to core through at least one of chemical bonds with atoms of the core, ion-dipole interactions, π-cation and π-π interactions, and surface adsorption (e.g., chemisorptions, and/or physisorption). The organic material may, for example, comprise at least one of a hydroxyethylcellulose material that is soluble in an aqueous material (e.g., fresh water, seawater, produced water, brine, aqueous-based foams, water-alcohol mixtures, etc.), a polyalkylene glycol-based material that is soluble in another organic material (e.g., a hydrocarbon material, such as crude oil, diesel, mineral oil, an ester, a refinery cut or blend, an alpha-olefin, a synthetic-based fluid, etc.), and an organosilane material that is soluble in an aqueous material or another organic material. In additional embodiments, at least some of the degradable particles are formed of and include a core comprising an Mg alloy (e.g., an Mg—Al alloy) and a shell comprising a relatively less degradable metal-containing material. The shell may, for example, be formed of and include Al, Bi, Cd, Ce, Ca, Co, Cu, Ce, Fe, Ga, In, Li, Mg, Mn, Ni, Sc, Si, Ag, Sr, Th, Sn, Ti, W, Y, Zn, Zr, carbides thereof, nitrides thereof, oxides thereof, or combinations thereof. As a non-limiting example, the metal-containing material may be an abrasive material, such as alumina, silica, titania, ceria, zirconia, germania, magnesia, a silicon carbide, a metal nitride, or a combination thereof. In further embodiments, at least some of the degradable particles are formed of and include a core comprising a hydrolyzable polymer and a shell comprising an organic material (e.g., an organosilane material, an hydroxyethylcellulose material, a polyalkylene glycol-based material, etc.) that is soluble in at least one of an aqueous material (e.g., fresh water, seawater, produced water, brine, aqueous-based foams, water-alcohol mixtures, etc.) and an organic material (e.g., a hydrocarbon material, such as diesel, crude oil, mineral oil, an ester, a refinery cut or blend, an alpha-olefin, a synthetic-based fluid, etc.).

If present, the shell may be formed on or over the core using conventional processes, which are not described in detail herein. The shell may, for example, be formed on or over the core through at least one of a thermal decomposition process, a chemical vapor deposition (CVD) process, a physical vapor deposition (PVD) process (e.g., sputtering, evaporation, ionized PVD, etc.), an atomic layer deposition (ALD) process, and a physical mixing process (e.g., cryomilling, ball milling, etc.). In some embodiments, a shell comprising a less degradable metal-containing material (e.g., alumina) is formed on a core comprising a more degradable metal material (e.g., at least one of Mg, Al, Ca, Mn, Zn, an alloy thereof, a combination thereof, etc.) or a water soluble metal salt (e.g., NaF, $CaF_2$, $MgF_2$, $MgCl_2$, $MgSO_4$, $FeCl_3$, $AlCl_3$) through thermal decomposition of organometallic compound. By way of non-limiting example, a shell formed of and including Al may be formed on a core formed of and including an Mg—Al alloy by thermally decomposing triethylaluminum ($C_6H_{15}Al$) in the presence of the core. The $C_6H_{15}Al$ and the core may, for example, be delivered into a fluidized bed operated under conditions (e.g., temperature, pressure, fluidization velocity, etc.) sufficient to form an Al-containing shell on the core. In additional embodiments, a shell comprising an organic material may be formed on a core comprising a more degradable metal material (e.g., at least one of Mg, Al, Ca, Mn, Zn, an alloy thereof, a combination thereof, etc.) or a hydrolyzable polymer (e.g., polylactide, poly(ϵ-caprolactone), poly(dioxanone), a polyester, a polyglycolide, a polyketal, poly(lactide-co-glycolide), a polyurea, a polyurethane, a silylated polyurethane, etc.) by exposing the core to a plurality of precursor compounds so that exposed atoms of the core chemically bond with at least a portion of the precursor compounds. The precursor compounds may react with and/or spontaneously absorb to the core, and the formation of the organic material may terminate when exposed atoms of the core are no longer available (e.g., unreacted with a precursor compound, or accessible for reaction with a precursor compound). Accordingly, the organic material may be self-assembled and self-limiting. For example, a self-assembled and self-limiting shell comprising a monolayer of an organosilane material may be formed on a core comprising an Mg—Al alloy by exposing the core to precursor compounds comprising at least one of chlorosilanes and alkoxysilanes. As another example, a self-assembled and self-limiting shell comprising a monolayer of organic material may be formed by exposing a core (e.g., a surface-treated core comprising an Mg—Al alloy) to precursor compounds comprising at least one of functional thiophenes, and functional thiols. In additional embodiments, the formation of the shell may not be self-limiting, and may continue even if there is no longer at least one exposed portion of the core.

At least some of the degradable particles may be functionalized to limit and/or enhance interactions between the degradable particles and different materials present within a hydrocarbon-bearing subterranean formation. For example, the degradable particles may be configured to exhibit an affinity for at least one material provided to and/or already present within the subterranean formation. Such an affinity may assist with the dispersion of the degradable particles within a carrier fluid (e.g., an aqueous material, an organic material, etc.) of the flooding suspension, may at least temporarily protect the degradable particle from at least one of material provided to and/or already present within the subterranean formation, may assist in the removal of a hydrocarbon material from surfaces of the subterranean formation, and/or may assist in the stabilization of mixtures (e.g., emulsions, such as hydrocarbon material dispersed in aqueous material emulsions, or aqueous material dispersed in hydrocarbon material emulsions) formed within and extracted from the subterranean formation. The degradable particles may be structured and formulated (e.g., through one or more functional groups) to be at least partially hydrophilic, hydrophobic, amphiphilic, oxophilic, lipophilic, and/or oleophilic. As a non-limiting example, hydrophilic functional groups may enable the degradable particles to more readily stabilize oil-water and/or oil-brine emulsions in which the continuous phase is water or brine, whereas hydrophobic functional groups may enable the degradable particles to more readily stabilize oil-water and/or oil-brine emulsions in which the continuous phase is oil. In some embodiments, the degradable particles are structured and formulated to exhibit an affinity for both an internal surface of the subterranean formation and a hydrocarbon material present within the subterranean formation. Such an affinity may, for example, enable the degradable particles to gather (e.g., agglomerate) at an interface between the internal surface of the subterranean formation and the hydrocarbon material to assist with removing the hydrocarbon material from the internal surface of the subterranean formation. Any portions (e.g., cores, shells, etc.) of the degradable particles may be functionalized to exhibit desired affinities and/or aversions for different materials.

Non-limiting examples of suitable functional groups for modifying the affinities and/or aversions of the degradable particles for different materials include carboxy groups; epoxy groups; ether groups; ketone groups; amine groups; hydroxy groups; alkoxy groups; alkyl groups, such as methyl, ethyl, propyl, butyl, pentyl, hexyl, octyl, dodecyl, and/or octadecyl groups; aryl groups, such as phenyl, and/or hydroxyphenyl groups; aralkyl groups; alkaryl groups, such as benzyl groups attached via the aryl portion (e.g., 4-methylphenyl, 4-hydroxymethylphenyl, or 4-(2-hydroxyethyl) phenyl, and/or aralkyl groups attached at the benzylic (alkyl) position, such as in phenylmethyl and 4-hydroxyphenylmethyl groups, and/or attached at the 2-position, such as in phenethyl and 4-hydroxyphenethyl groups); lactone groups; imidazole and pyridine groups; fluorinated groups; functionalized polymeric groups, such as acrylic chains having carboxylic acid groups, hydroxyl groups, and/or amine groups; functionalized oligomeric groups; and/or combinations thereof. The functional groups may be attached to the degradable particles directly, and/or through intermediate functional groups (e.g., carboxy groups, amino groups, etc.) by way of one or more conventional reaction mechanisms (e.g., amination, nucleophilic substitution, oxidation. Stille coupling, Suzuki coupling, diazo coupling, organometallic coupling, etc.). In further embodiments, at least some of the degradable particles are formulated to exhibit desired affinities and/or aversions for different materials without having to perform additional processing acts to attach functional groups thereto. For example, one or more portions (e.g., shells, cores, etc.) of at least some of the degradable particles may already exhibit desired affinities and/or aversions for different materials without having to perform additional functionalization acts.

Each of the degradable particles may have substantially the same surface modification (e.g., shell, surface functionalization, combination thereof, etc.), the surface modification of at least one of the degradable particles may be different than the surface modification of at least one other of the degradable particles, or at least one of the degradable particles may have substantially no surface modification. In some embodiments, each of the degradable particles has substantially the same surface modification. In additional embodiments, a portion of the degradable particles has substantially the same surface modification, and another portion of the degradable particles has a different surface modification. In further embodiments, a portion of the degradable particles has at least one type of surface modification, and another portion of the degradable particles is substantially free of surface modifications. In yet further embodiments, each of the degradable particles is substantially free of surface modifications.

The size and shape of each of the degradable particles may be selected based on the characteristics of the hydrocarbon-bearing subterranean formation. For example, the degradable particles may be sized and shaped to fit within interstitial spaces (e.g., pores, cracks, fractures, channels, etc.) of the subterranean formation. In addition, the degradable particles may be sized and shaped based on one or more properties (e.g., molecular weight, density, viscosity, etc.) of a hydrocarbon material contained within the interstitial spaces of the subterranean formation. Relatively smaller particles may, for example, be selected to increase the stability of an emulsion including an aqueous material (e.g., water, brine, etc.) and a hydrocarbon material from the subterranean formation. In some embodiments, the degradable particles may comprise degradable nanoparticles. As used herein the term "nanoparticle" means and includes a particle having an average particle width or diameter of less than about 1 micrometer (μm) (i.e., 1000 nanometers). Each of the degradable particles may, for example, independently have an average particle width or diameter of less than or equal to about 500 nanometers (nm), such as less than or equal to about 100 nm, less than or equal to about 50 nm, less than or equal to about 10 nm, or less than or equal to about 1 nm. In additional embodiments, one or more of the degradable particles may have an average particle width or diameter greater than or equal to about 1 μm, such as within a range of from about 1 μm to about 25 μm, from about 1 μm to about 20 μm, or from about 1 μm to about 10 μm. Furthermore, each of the degradable particles may independently be of a desired shape, such as at least one of a spherical shape, a hexahedral shape, an ellipsoidal shape, a cylindrical shape, a platelet shape, a conical shape, or an irregular shape. In some embodiments, each of the degradable particles has a substantially spherical shape.

The degradable particles may be monodisperse, wherein each of the degradable particles has substantially the same size, shape, and material composition, or may be polydisperse, wherein the degradable particles include a range of sizes, shapes, and/or material compositions. In some embodiments, each of the degradable particles comprises an Mg—Al alloy nanoparticle having substantially the same size and the same shape as each other of the degradable particles. In additional embodiments, each of the degradable particles comprises an Mg—Al alloy core covered with a shell comprising substantially the same material (e.g., substantially the same metal material, substantially the same organic material, etc.), and having substantially the same size and the same shape as each other of the degradable particles. In further embodiments, each of the degradable particles comprises a hydrolyzable polymer nanoparticle having substantially the same size and the same shape as each other of the degradable particles. In further embodiments, each of the degradable particles comprises a hydrolyzable polymer core covered with a shell comprising substantially the same material (e.g., substantially the same organic material, etc.), and having substantially the same size and the same shape as each other of the degradable particles. In yet further embodiments, at least one of the degradable particles comprises a different size, a different shape, and/or a different material composition than at least one other of the degradable particles.

The concentration of the degradable particles in the flooding suspension may be tailored to the amount and material composition of the hydrocarbon material contained within the subterranean formation. The flooding suspension may include a sufficient amount of the degradable particles to facilitate the removal (e.g., detachment) of the hydrocarbon material from surfaces of the subterranean formation. In addition, the flooding suspension may include a sufficient amount of the degradable particles to facilitate the formation of a stabilized emulsion (e.g., a Pickering emulsion) of the hydrocarbon material and an aqueous material. By way of non-limiting example, the solution may comprise from about 0.001 percent by weight (wt %) to about 20 wt % degradable particles, such as from about 0.001 wt % to about 10 wt % degradable particles, from about 0.001 wt % to about 5 wt % degradable particles, from about 0.001 wt % to about 1 wt % degradable particles, or from about 0.001 wt % to about 0.1 wt % degradable particles.

The carrier fluid of the flooding suspension may comprise any flowable material that is compatible with the degradable particles of the flooding suspension. The carrier fluid may, for example, comprise at least one of an aqueous material and an organic material. Non-limiting examples of suitable aqueous materials include fresh water, seawater, produced water, steam, brines (e.g., mixtures of water and at least one salt, such as water and at least one of ammonium chloride, calcium chloride, calcium bromide, magnesium chloride, magnesium boride, potassium chloride, potassium formate, sodium chloride, sodium boride, sodium formate, zinc bromide, zinc formate, and zinc oxide), aqueous-based foams, water-alcohol mixtures, or combinations thereof. Non-limiting examples of suitable organic materials include oils and non-polar liquids useful for downhole applications, such as crude oil, diesel, mineral oil, esters, refinery cuts and blends, alpha-olefins, and synthetic-based materials including surfactants, emulsifiers, corrosion inhibitors and other chemicals commonly used in downhole applications (e.g., ethylene-olefin oligomers, fatty acid esters, fatty alcohol esters, ethers, polyethers, paraffinic hydrocarbons, aromatic hydrocarbons, alkyl benzenes, terpenes, etc.). The carrier fluid may be selected based on one or more properties of the degradable particles. For example, the carrier fluid may be selected to delay, limit, or even prevent substantial degradation of the degradable particles until after a stabilized emulsion including a hydrocarbon material from the subterranean formation has been formed and removed from the subterranean formation. In some embodiments, exposed portions of the degradable particles comprise a water-reactive material (e.g., a metal material formed of and including at least one of Mg, Al, Ca, Mn, Zn, an alloy thereof, a combination thereof; a hydrolyzable polymer; etc.) and the carrier fluid comprises an aqueous material (e.g., water, brine, etc.). In further embodiments, exposed portions of the degradable particles comprise a water-reactive material (e.g., an organic material) that is less reactive than another portion (e.g., an internal portion) of the degradable particles, and the carrier fluid comprises at least one of an aqueous material and an organic material.

In addition, the flooding suspension may, optionally, include at least one additive. By way of non-limiting example, the additive may be at least one of a surfactant, an emulsifier, a corrosion inhibitor, a catalyst, a dispersant, a scale inhibitor, a scale dissolver, a defoamer, a biocide, and/or a different additive conventionally utilized in the well service industry. The type and amount of the additive may at least partially depend on the properties of the degradable particles, on the properties of the subterranean formation, and on the properties of the hydrocarbon material contained within the subterranean formation. The flooding suspension may be substantially homogeneous (e.g., the degradable particles and the additive, if present, may be uniformly dispersed throughout the flooding suspension), or may be heterogeneous (e.g., the degradable particles and the additive, if present, may be non-uniformly dispersed throughout the flooding suspension).

In some embodiments, the additive comprises at least one surfactant. The surfactant may, for example, be a material configured to enhance the stability of an emulsion of an aqueous material and a hydrocarbon material. The surfactant may serve as an additional barrier (e.g., in addition to the degradable particles) to the coalescence of adjacent droplets (e.g., discrete agglomerations) of the hydrocarbon material before, during, and after the extraction of the hydrocarbon material from a subterranean formation containing the hydrocarbon material. The surfactant may be any anionic, non-ionic, zwitterionic, or amphiphilic surfactant compatible with hydrocarbon material and with the other components (e.g., the degradable particles, the carrier fluid, etc.) of the fluid. Non-limiting examples of suitable surfactants include fatty acids having a carbon chain length of up to about 22 carbon atoms, such as stearic acids, and esters thereof; poly(alkylene glycols), such as poly(ethylene oxide), poly(propylene oxide), and block and random poly (ethylene oxide-propylene oxide) copolymers; and polysiloxanes, such as silicone polyethers having both a hydrophilic part (low-molecular-weight polymer of ethylene oxide or propylene oxide or both) and a hydrophobic part (the methylated siloxane moiety).

In further embodiments, the additive comprises at least one catalyst. The catalyst may, for example, comprise a plurality of catalyst particles. The catalyst particles may be structured and formulated to facilitate, mediate, and/or enhance one or more reactions with the degradable particles. For example, the catalyst particles may accelerate reaction rates between the degradable particles and at least one of an aqueous material and an organic material. As a non-limiting example, if the degradable particles are formed of and include a reactive metal material (e.g., at least one of Mg, Al, Ca, Mn, Zn, an alloy thereof, a combination thereof, etc.), the catalyst particles may accelerate electrochemical reactions between at least a portion of the degradable particles and an aqueous material. The catalyst particles may be relatively cathodic in the presence of the aqueous material, whereas the degradable particles may be relative anodic in the presence of the aqueous material. The catalyst particles may thus promote (e.g., enhance) electrochemical degradation of the degradable particles in the presence of an electrolyte. The catalyst particles may be more resistant, under substantially similar environmental conditions, to degradation (e.g., corrosion, dissolution, decomposition, etc.) than the degradable particles. As a non-limiting example, if the degradable particles are formed of and include a reactive metal material (e.g., a material comprising at least one of Mg, Al, Ca, Mn, Zn, an alloy thereof, a combination thereof, etc.), the catalyst particles may be formed of and include a relatively less reactive metal material such as various grades of steels, tungsten (W), chromium (Cr), Ni, Cu, Co, Fe, alloys thereof, or combinations thereof. The size and the shape of each of the catalyst particles may be substantially the same as the size and the shape of each of the degradable particles, or at least one the size and the shape of at least one of the catalyst particles may be different than at least one of the size and the shape of at least one of the degradable particles. In some embodiments, the catalyst particles comprise nanoparticles formed of and including at least on of W, Cr, Ni, Cu, Co, and Fe. A concentration of the catalyst particles may be sufficiently low so as to have minimal, if any, effect on the stability of an emulsion formed using the flooding suspension, as described in further detail below.

With continued reference to FIG. 1, the flooding process 102 includes providing the flooding suspension into a hydrocarbon-bearing subterranean formation. The flooding suspension may be provided into the subterranean formation through conventional processes, which are not described in detail herein. For example, a pressurized stream of the flooding suspension may be pumped into an injection well extending to a desired depth in the subterranean formation, and may infiltrate (e.g., permeate, diffuse, etc.) into interstitial spaces of the subterranean formation. The extent to which the flooding suspension infiltrates into the interstitial spaces of the subterranean formation at least partially depends on the properties of the flooding suspension (e.g., density, viscosity, particle size, temperature, pressure, etc.), the subterranean formation (e.g., porosity, pore size, material composition, etc.), and the hydrocarbon materials (e.g., molecular weight, density, viscosity, etc.) contained within the interstitial spaces of the subterranean formation. An injection temperature of the flooding suspension may be sufficiently low as to substantially limit or even prevent a premature reaction between the degradable particles and another material (e.g., an aqueous material, such as water, brine, etc.) being delivered into and/or already present within the subterranean formation. In some embodiments, the flooding suspension is delivered into the subterranean formation at a temperature less than or equal to an ambient downhole temperature of the subterranean formation. By way of non-limiting example, the flooding suspension may be delivered into the subterranean formation at a temperature less than or equal to about 50° C., such as less than or equal to about 40° C., or less than or equal to about 35° C.

During the flooding process 102, at least some of the degradable particles of the flooding suspension may abrasively remove at least a portion of the hydrocarbon material contained within the subterranean formation from internal surfaces (e.g., pore surfaces, crack surfaces, fracture surfaces, channel surfaces, etc.) of the subterranean formation. In addition, at least some of the degradable particles may aggregate in a confined rock-oil-brine three-phase contact region of the subterranean formation to provide a disjoining pressure and detach at least a portion of the hydrocarbon material contained within the subterranean formation from the internal surfaces of the subterranean formation. Furthermore, at least some of the degradable particles may gather (e.g., agglomerate) at, adhere to, and/or adsorb to interfaces of the hydrocarbon material and an aqueous material (e.g., an aqueous material derived from the carrier fluid of the flooding suspension, and an aqueous component already contained within the subterranean formation) to form a stabilized emulsion (e.g., a Pickering emulsion) comprising units (e.g., droplets) of one of the hydrocarbon material and the aqueous material dispersed in the other of the hydrocarbon material and an aqueous material. In some embodiments, the stabilized emulsion comprises units of the hydrocarbon material dispersed in an aqueous material. The degradable particles may prevent the dispersed material (e.g., the hydrocarbon material, or the aqueous material) from coalescing, and may thus maintain the dispersed material as units throughout the other material. In additional embodiments, the emulsion may be further stabilized using a surfactant. The stabilized emulsion may be flowed (e.g., driven, swept, forced, etc.) from the subterranean formation during the flooding process 102.

Next, in the degradation process 104, after removing the stabilized emulsion from the subterranean formation, at least a portion of the degradable particles thereof may be at least partially degraded. One or more properties (e.g., temperature, pH, material composition, pressure, etc.) of the stabilized emulsion may be modified (e.g., altered, changed) to at least partially degrade (e.g., corrode, dissolve, decompose, etc.) the degradable particles, or the properties of the stabilized emulsion may be retained (e.g., unmodified, maintained, sustained, preserved, etc.) to at least partially degrade the degradable particles. In some embodiments, at least some of the degradable particles are degraded over time without directly modifying one or more properties (e.g., temperature, pH, material composition, pressure, etc.) of the stabilized emulsion. For example, at least some of the degradable particles may be degraded over time without heating, decreasing the pH, adding materials to, and/or modifying the pressure of the stabilized emulsion. In additional embodiments, at least one environmental condition (e.g., temperature, pH, material exposure, pressure, etc.) to which the degradable particles of the stabilized emulsion are exposed may be modified to adjust (e.g., increase, decrease) a degradation rate of the degradable particles. The degradation of at least a portion of the degradable particles may destabilize the emulsion and coalesce the hydrocarbon material and the aqueous material into distinct, immiscible phases.

As a non-limiting example, after removing the stabilized emulsion from the subterranean formation, the temperature of the stabilized emulsion may be modified to facilitate degradation of the degradable particles. In some embodiments, the temperature of the stabilized emulsion is increased to facilitate and/or enhance reactions between the degradable particles and the aqueous material. The temperature of the stabilized emulsion may, for example, be increased to be greater than or equal to about 25° C., such as greater than or equal to about 35° C., greater than or equal to about 50° C., greater than or equal to about 75° C., greater than or equal to about 100° C., or greater than or equal to about 200° C. If the degradable particles are less than completely encapsulated (e.g., covered) with less degradable shells and/or non-degradable shells (e.g., where less degradable shells and/or non-degradable shells are substantially absent from the degradable particles, where the degradable particles comprise degradable cores partially encapsulated with less degradable shells and/or non-degradable shells, etc.), an increase in the temperature of the stabilized emulsion may increase the rate at which the aqueous material degrades (e.g., corrodes, dissolves, decomposes, etc.) the degradable particles. Conversely, if the degradable particles comprise degradable cores substantially covered with less degradable shells and/or non-degradable shells, an increase in the temperature of the stabilized emulsion may facilitate thermal expansion of the degradable cores to damage (e.g., crack, break open, etc.) the less degradable shells and/or non-degradable shells, expose the degradable cores to the aqueous material, and increase the rate at which the aqueous material degrades the degradable cores. After a sufficient amount of the degradable particles are degraded (e.g., corroded, dissolved, etc.) as a result of the change in temperature, the hydrocarbon material and the remaining aqueous material may coalesce into distinct, immiscible phases.

As another non-limiting example, after removing the stabilized emulsion from the subterranean formation, the pH of the stabilized emulsion may be modified to facilitate and/or enhance degradation of the degradable particles. For example, the pH of the stabilized emulsion is decreased by exposing (e.g., contacting) the stabilized emulsion to a material having a pH less than that of the stabilized emulsion. For example, at least one of hydrochloric acid (HCl), hydrobromic acid (HB), nitric acid ($HNO_3$), sulfuric acid ($H_2SO_4$), phosphoric acid ($H_3PO_4$), formic acid ($CH_2O_2$), and acetic acid ($C_2H_4O_2$) may be added to the stabilized emulsion. In some embodiments, at least one of aqueous HCl and aqueous $H_2SO_4$ is added to the stabilized emulsion. If the degradable particles are less than completely encapsulated (e.g., covered) with less degradable shells and/or non-degradable shells, a decrease in the pH of the stabilized emulsion may increase the rate at which the degradable particles are degraded (e.g., corroded, dissolved, decomposed, etc.). If the degradable particles comprise degradable cores substantially covered with less degradable shells, a decrease in the pH of the stabilized emulsion may increase the rate at which the less degradable shells are degraded to more rapidly expose the degradable cores, and may also increase the rate at which the degradable cores are degraded in the absence of the shells. After a sufficient amount of the degradable particles are degraded (e.g., corroded, dissolved, etc.) as a result of the change in pH, the hydrocarbon material and the remaining aqueous material may coalesce into distinct, immiscible phases.

After coalescing the hydrocarbon material and the aqueous material into distinct, immiscible phases, one or more processes (e.g., reaction processes, filtration processes, precipitation processes, settling processes, etc.) may be utilized to separate, collect, and/or further process the hydrocarbon material. The hydrocarbon material may be utilized as desired.

While the disclosure is susceptible to various modifications and alternative forms, specific embodiments have been shown by way of example in the drawings and have been described in detail herein. However, the disclosure is not intended to be limited to the particular forms disclosed. Rather, the disclosure is to cover all modifications, equivalents, and alternatives falling within the scope of the disclosure as defined by the following appended claims and their legal equivalents.

What is claimed is:

1. A method of obtaining a hydrocarbon material from a subterranean formation, comprising:

forming a flooding suspension consisting essentially of degradable particles and a liquid consisting essentially of fresh water, seawater, produced water, a brine, an aqueous-based foam, or a water-alcohol mixture, each of the degradable particles comprising:

a core comprising one or more of Mg, Al, Ca, Mn, and Zn; and an alumina shell directly on and completely encapsulating the core;

introducing the flooding suspension into a subterranean formation containing a hydrocarbon material to form an emulsion stabilized by the degradable particles;

removing the emulsion from the subterranean formation; and heating the emulsion to a temperature greater than or equal to about 50° C. after removing the emulsion from the subterranean formation to thermally expand cores and damage alumina shells of at least a portion of the degradable particles to effectuate degradation of the at least a portion of the degradable particles and destabilize the emulsion.

2. The method of claim 1, wherein forming a flooding suspension consisting essentially of degradable particles and a liquid comprises forming the degradable particles to be one or more of hydrophilic, hydrophobic, amphiphilic, oxophilic, lipophilic, and oleophilic.

3. The method of claim 1, wherein forming a flooding suspension consisting essentially of degradable particles and a liquid comprises forming the flooding suspension to comprise from about 0.001 percent by weight to about 20 percent by weight degradable particles.

4. The method of claim 1, wherein introducing the flooding suspension into a subterranean formation containing a hydrocarbon material comprises introducing the flooding suspension into the subterranean formation at a temperature of less than or equal to about 50° C.

5. The method of claim 1, wherein introducing the flooding suspension into a subterranean formation containing a hydrocarbon material to form an emulsion stabilized by the degradable particles comprises forming an emulsion comprising the hydrocarbon material dispersed within an aqueous material.

6. The method of claim 1, wherein degrading the at least a portion of the degradable particles comprises modifying at least one property of the removed emulsion.

7. A method of obtaining a hydrocarbon material from a subterranean formation, comprising:

selecting nanoparticles each comprising at least one reactive Mg alloy comprising Mg and one or more of W and Cr;

selecting a liquid from the group consisting of fresh water, seawater, produced water, a brine, an aqueous-based foam, and a water-alcohol mixture;

selecting at least one additive from the group consisting of catalyst nanoparticles, a surfactant, an emulsifier, a corrosion inhibitor, a dispersant, a scale inhibitor, a scale dissolver, a defoamer, and a biocide;

combining the nanoparticles with the liquid and the at least one additive to form a flooding suspension consisting essentially of the nanoparticles, the liquid, and the at least one additive;

injecting the flooding suspension into a subterranean formation having a hydrocarbon material attached to surfaces thereof to detach the hydrocarbon material from the surfaces and form an emulsion stabilized by the nanoparticles;

directing the emulsion out of the subterranean formation; and heating the emulsion to a temperature greater than or equal to about 25° C. after directing the emulsion out of the subterranean formation to react at least a portion of the nanoparticles with an aqueous material of the emulsion to destabilize the emulsion and coalesce the hydrocarbon material.

8. The method of claim 7, wherein selecting nanoparticles each comprising at least one reactive Mg alloy comprising Mg and one or more of W and Cr comprises selecting the at least one reactive Mg alloy to further comprise one or more of Al, Bi, Cd, Ce, Co, Cu, Fe, Ga, In, Li, Mn, Ni, Sc, Si, Ag, Sr, Th, Sn, Ti, Zn, Y, and Zr.

9. The method of claim 7, wherein selecting at least one additive comprises selecting the catalyst nanoparticles, the catalyst nanoparticles each comprising at least one of W and Cr.

10. The method of claim 7, wherein selecting at least one additive comprising selecting the surfactant.

* * * * *